US005995784A

United States Patent [19]

Tempaku

[11] Patent Number: 5,995,784

[45] Date of Patent: Nov. 30, 1999

[54] SAFETY MECHANISM FOR OPEN/CLOSE DOOR MEMBER OF IMAGE FORMING APPARATUS

[75] Inventor: Chitose Tempaku, Toride, Japan

[73] Assignee: Canon Kabushiki Kaisha, Tokyo, Japan

[21] Appl. No.: 08/994,438

[22] Filed: Dec. 19, 1997

[30] Foreign Application Priority Data

Dec. 26, 1996 [JP] Japan ..... 8-348843

[51] Int. Cl.[6] ..... G03G 15/00; G03G 21/16

[52] U.S. Cl. ..... 399/125

[58] Field of Search ..... 399/107, 125; 49/9; 16/335, 321; 292/338, DIG. 15

[56] References Cited

U.S. PATENT DOCUMENTS

| | | | |
|---|---|---|---|
| 4,178,655 | 12/1979 | Little | 292/338 X |
| 4,789,876 | 12/1988 | Miyai et al. | 399/125 X |
| 4,908,659 | 3/1990 | Ishii et al. | 399/125 |
| 5,175,583 | 12/1992 | Noh et al. | 399/107 |
| 5,379,092 | 1/1995 | Takashima | 399/125 |
| 5,860,044 | 1/1999 | Eki et al. | 399/125 |

FOREIGN PATENT DOCUMENTS 2263303 7/1993 United Kingdom .

*Primary Examiner*—Susan S.Y. Lee

*Attorney, Agent, or Firm*—Fitzpatrick, Cella, Harper & Scinto

[57] ABSTRACT

A safety mechanism for an open/close door member of an image forming apparatus includes a door member rotated around one axis to be opened and closed in a gravity force direction, a first lever member abutting against the door member in a closed condition, a second lever rotatably attached to an apparatus body and adapted to support the first lever member, and a biasing member for biasing the first and second lever members. When a load acting on the first lever member from the door member is greater than a set value, the lever member is shifted to a predetermined position to function as a stop device for stopping rotation of the door member, and, when the load is smaller than the set value, the rotation of the door member is permitted.

4 Claims, 11 Drawing Sheets

SAFETY MECHANISM FOR OPEN/CLOSE DOOR MEMBER OF IMAGE FORMING APPARATUS

BACKGROUND OF THE INVENTION

1. Field of the Invention

The present invention relates to a safety mechanism for an open/close door member of an image forming apparatus such as a printer, a facsimile apparatus and the like.

2. Related Background Art

As an example of an equipment having an open/close member, a construction and a function of a laser beam printer using an electrophotographic process will be explained with reference to FIG. 10.

FIG. 10 is an elevational sectional view of the laser beam printer. In FIG. 10, the reference numeral 1 denotes a body of the printer; 2 denotes a cassette in which transfer sheets S are stacked; 21 denotes a sheet supply roller for picking up the transfer sheets S one by one from the cassette 2; 22 denotes a pair of regist rollers for controlling a convey timing of the transfer sheet S; 3 denotes a transfer charge roller; and 4 denotes a process cartridge. The process cartridge 4 incorporates therein at least a photosensitive drum 71, a developing device (not shown), a charger (not shown) a toner containing portion (not shown) and a cleaning device for the photosensitive drum as a cartridge unit which can detachably be mounted to the printer body 1.

A fixing device 5 includes a halogen heater 52, an aluminium fixing roller 51 and a rubber pressure roller 53. Developer on the transfer sheet S is fused by heat and pressure from the fixing roller 51 and the pressure roller 53 to be fixed to the transfer sheet S.

The reference numeral 23 denotes a pair of convey rollers; 24 denotes a pair of discharge rollers; 6 denotes a scanner unit for scanning the photosensitive drum 71 by reflecting a laser beam emitted from a laser generator (not shown) onto the photosensitive drum through a mirror 61; and 62 denotes a reflection mirror for directing the laser beam to the photosensitive drum 71.

Next, a printing operation will be described.

When a print signal is inputted from a host computer (not shown), the transfer sheet S is picked up from the cassette 2 by the sheet supply roller 21. The transfer sheet S is conveyed by the pair of regist rollers 22 at a timed relation to a tip end of a developed image on the photosensitive drum 71, and the developed image written on the photosensitive drum 71 by the laser beam and developed by the developing device is transferred onto the transfer sheet S by means of the transfer charge roller 3. The transfer sheet S to which the developed image was transferred is sent to the fixing device 5, where the developed image is fixed to the transfer sheet as mentioned above, and, then, the transfer sheet is conveyed and discharged by the pair of discharge roller 24.

In the above-mentioned laser beam printer, the process cartridge 4 is a consumed part, as well as the transfer sheet S. Further, an operator must dismount the process cartridge from the printer body if sheet jam occurs, in order to remove the jammed sheet.

In order to facilitate the replacement and mounting/dismounting of the process cartridge 4 effected by the operator, as shown in FIG. 11, the laser beam printer has an open/close door (referred to merely as "door" hereinafter) 7. The door 7 is closed to be positioned at a position X during the printing operation. However, when the process cartridge 4 is replaced or mounted or dismounted, the door is greatly opened to a position Y to facilitate the replacement and mounting/dismounting of the process cartridge 4.

However, the above-mentioned laser beam printer has the following disadvantage. That is to say, when the door 7 is opened to the position Y in FIG. 11 to perform the jam treatment, for example, if any shock acts on the printer body 1, the door 7 may be dropped from the position Y due to the shock to damage the printer body 1.

To avoid such inconvenience, the following countermeasures have been proposed:

(a) The door 7 is biased toward the position Y by using an elastic member to cancel the dropping force of the door 7;

(b) A stopping force providing "click feeling" is generated at the position Y to thereby prevent the dropping of the door 7; or (c) The dropping force of the door 7 is weakened by providing a resist member generating a damper effect.

However, as the apparatus body has recently been made compact and light-weighted and personalized, since the arrangement of the apparatus is limited in order to improve operability, it is comprehended that the above-mentioned countermeasures cannot be adopted. For example, since outer members of the apparatus have relatively weak strength due to molded parts, if the biasing force is applied as the above item (a), the outer members will be deformed or creep will be generated in the outer members. Further, since the opening of the door is great, if the resist member generating the damper effect is provided in the vicinity of a fulcrum of the door as the above item (c), a damper generating a great force is required. The provision of such a damper is difficult in consideration of the installation space and, if such a damper is provided, the resistance force becomes great in comparison with the strength of the door, with the so that the fulcrum of the door may be damaged. Further, if there is a danger of applying a force exceeding the stopping force as the above item (b) to the door, the stopping force cannot eliminate the above inconvenience.

As mentioned above, if the problem regarding the dropping of the door cannot be solved by adding any function to the fulcrum of the door, any stopper is required to weaken the shock. However, in such a stopper, there arises a problem regarding the release of the stopper. That is to say, if the stopper is provided, when the operator tries to close the door, the door cannot be closed by the presence of the stopper. In this case, in order to release the stopper, the following two methods have been proposed:

(i) The door can be closed by overriding the click when the door is pushed with a strong force; and (ii) After the stopper is manually released by the operator, the door is closed.

However, the operator cannot judge which method is used, resulting in an erroneous operation, or erroneously judges as the method (i) (although the method (ii) is actually adopted) to damage the stopper.

In order to eliminate such disadvantages, a stopper which is not operated by a normal operation and is operated only when a strong force is applied is required. To provide such a function, a mechanism of so-called "sheet belt type" is considered. However, since the sheet belt type cannot be judged a position where the function is operated, a "stopper responsive to only a shock force" is sometimes more effective.

SUMMARY OF THE INVENTION

An object of the present invention is to provide a safety mechanism of an open/close door member of an image forming apparatus, which has a simple construction.

Another object of the present invention is to provide a safety mechanism of an open/close door member of an image forming apparatus, which is not operated in a normal opening/closing operation of the door member and which stops the operation of the door member only in an abnormal opening/closing operation.

To achieve the above objects, according to the present invention, there is provided a safety mechanism for an open/close door member of an image forming apparatus, comprising a door member rotated around one axis and opened and closed in a gravity force direction, a first lever member abutting against the door member in a closed condition, a second lever rotatably attached to an apparatus body to support the first lever member, and means for biasing the first and second lever members. Wherein, when a load acting on the first lever member from the door member is greater than a set value, the lever member is shifted to a predetermined position to function as a stop device for stopping rotation of the door member, and, when the load is smaller than the set value, the rotation of the door member is permitted.

DETAILED DESCRIPTION OF THE PREFERRED EMBODIMENTS

The present invention will now be explained in connection with embodiment thereof with reference to the accompanying drawings.

<First Embodiment>

A first embodiment of the present invention will be described with reference to FIGS. 1 to 4.

Figure 1:
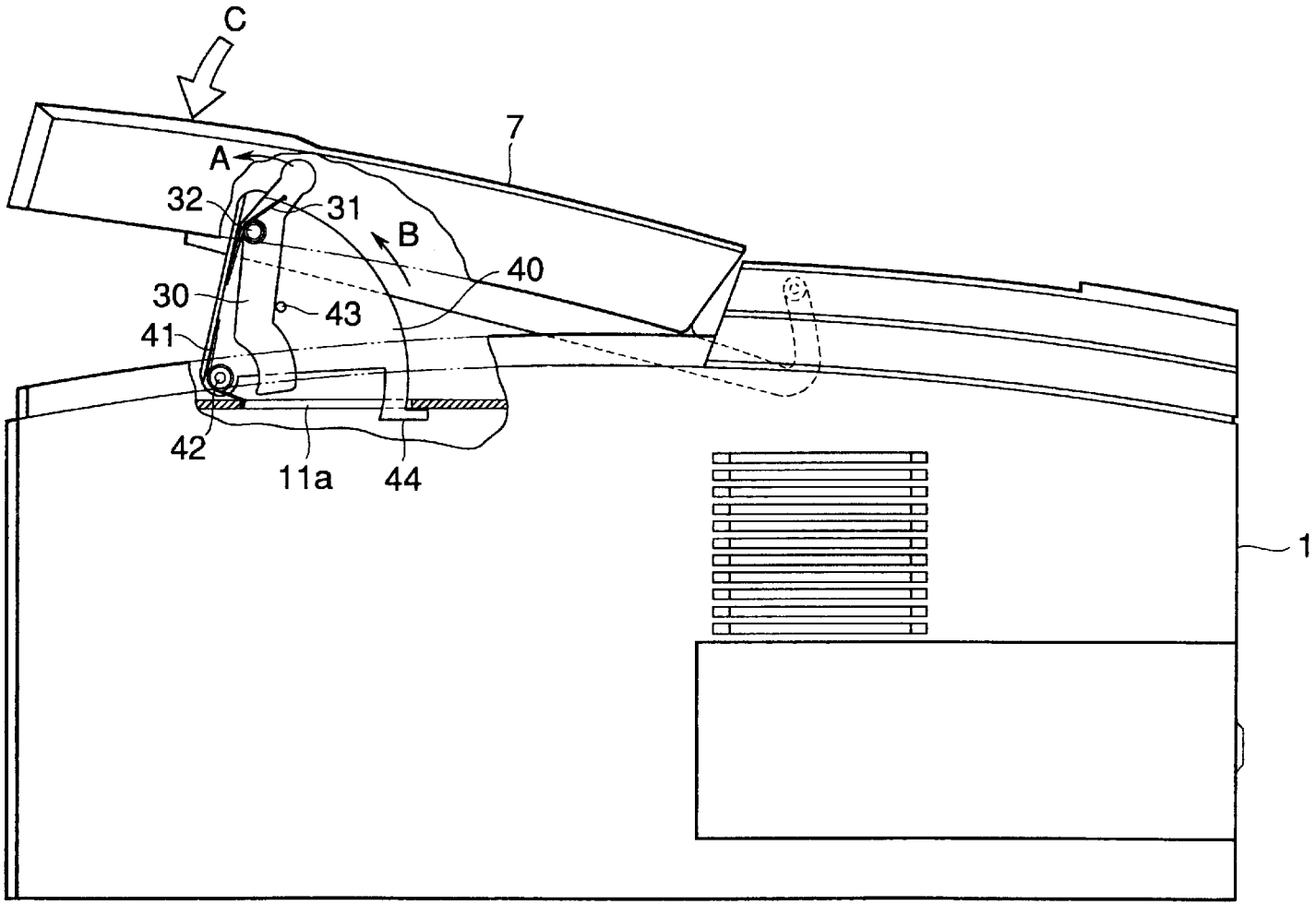
FIG. 1 is a side view of a laser beam printer having a safety mechanism according to a first embodiment of the present invention.

In a laser beam printer shown in FIG. 1, the reference numeral 1 denotes a body of the printer; and 7 denotes an open/close door opened and closed when a process cartridge is replaced or sheet jam treatment is effected.

A safety mechanism according to the present invention comprises two levers 30, 40 and two springs 31, 41. The lever 40 has a sector shape and is rotatably supported on a support shaft 42 of a body cover 11 of the printer body. The lever 40 is biased toward a direction shown by the arrow B in FIG. 1 by means of the spring 41 mounted on the support shaft 42, so that a phase of the lever is determined by abutting a stopper portion 44 against the body cover 11. The lever 30 is rotatably supported on a support shaft 32 formed on the lever 40 and is biased toward a direction shown by the arrow A in FIG. 1 by means of the spring 31 mounted on the support shaft 32, so that a phase of the lever 30 is determined by abutting the lever against a stopper 43 of the lever 40.

Figure 2:
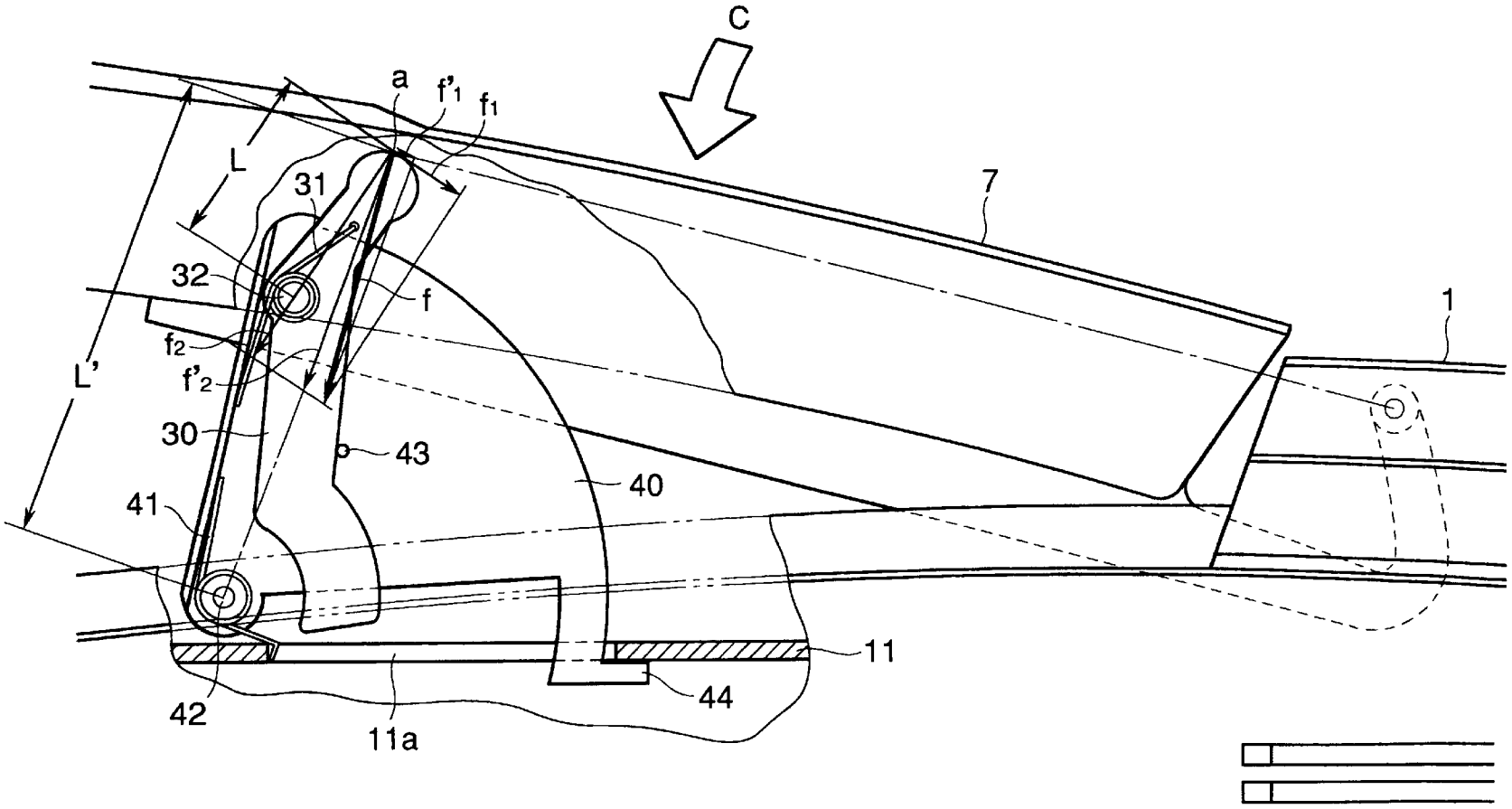
FIG. 2 is an enlarged detailed view of the safety mechanism of the laser beam printer of FIG. 1.

As shown in FIG. 2, when the door 7 is being closed toward a direction shown by the arrow C, the door 7 abuts against the safety mechanism at a point a on the lever 30. As a result, due to weight and inertia of the door, the safety mechanism is subjected to a force f from the door at the contact point a. A force component $f_1$ of the force f acts as a force trying to rotate the lever 30 in a clockwise direction (FIG. 2) around the support shaft 32, and a force component $f_2$ acts on the support shaft 32. A force component $f_1'$ acts as a force trying to rotate the lever 40 in a clockwise direction (FIG. 2) around the support shaft 42, and a force component $f_2'$ acts on the support shaft 42.

Accordingly, when it is assumed that a distance between the contact point a and a center of the support shaft 32 is L, moment $T_{30}$ trying to rotate the lever 30 around the support shaft 32 is represented by the following equation:

$$T_{30} = f_1 \times L - (\text{moment of spring 31}) - (\text{moment load due to friction force})$$

Similarly, when it is assumed that a distance between the contact point a and a center of the support shaft 42 is L', moment $T_{40}$ trying to rotate the lever 40 around the support shaft 42 is represented by the following equation:

$$T_{40} = f_1' \times L' - (\text{moment of spring 41}) - (\text{moment load due to friction force})$$

In the illustrated embodiment, when the door 7 is closed slowly, the following relation is established between the moment $T_{30}$ and the moment $T_{40}$, including stationary coefficient of friction:

$$15 \times T_{30} \leqq T_{40}.$$

Figure 3:
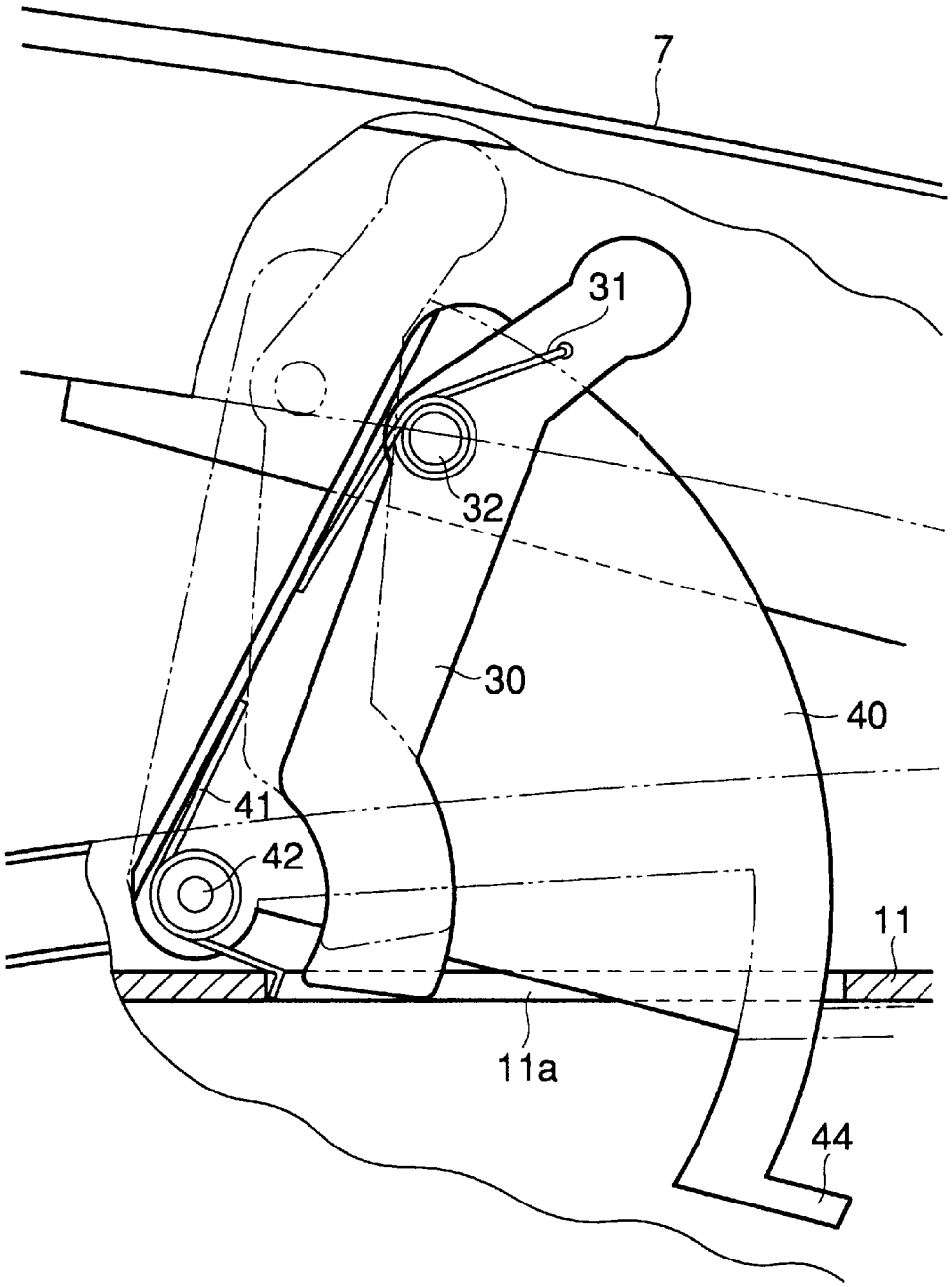
FIGS. 3 and 4 are explanatory views for explaining an operation of the safety mechanism according to the first embodiment.
Figure 4:
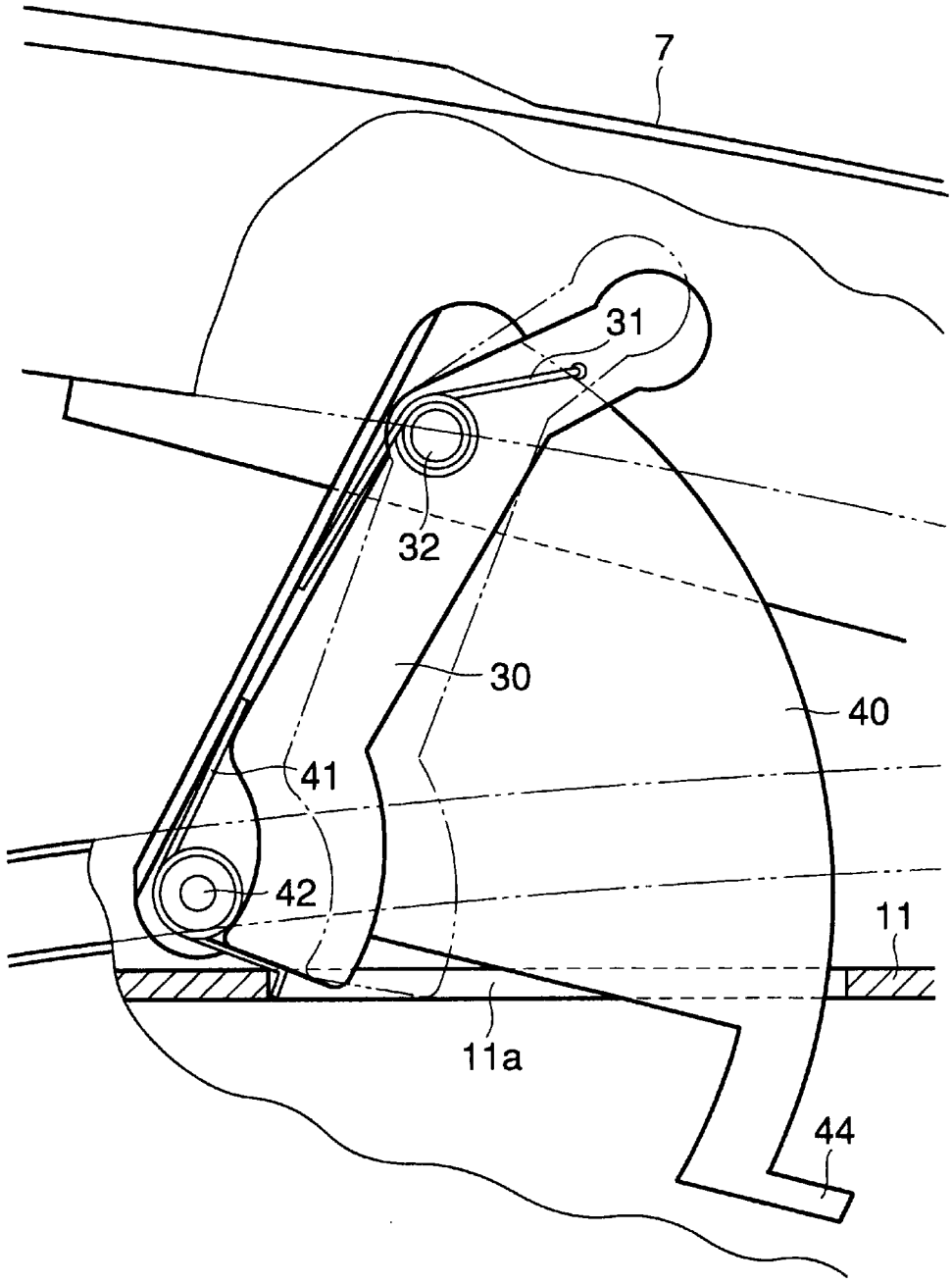

In the safety mechanism including the lever 30 and the lever 40, so long as the lever 30 is rotated by an angle smaller than a certain angle, as shown in FIG. 3, since the lever 30 and the lever 40 are rotated to be entered into a slit 11*a* formed in the body cover 11, the lever 40 can be rotated greatly to thereby close the door 7. However, when the lever 30 is rotated more than the certain angle, as shown in FIG. 4, the lever 30 cannot enter into the slit 11*a* and abuts against the body cover 11, so the lever 40 cannot be rotated. As a result, the door 7 cannot be closed.

So long as a relation in which the lever 30 is rotated by an angle smaller than 1/15 of the lever 40 is maintained, the lever 30 has the phase in which the lever can pass through the slit 11*a*. Accordingly, when the door 7 is being closed with a movement that the force acts on the safety mechanism in a static loading manner, the lever 40 can be rotated by an angle greater than 75°, so that the door 7 can be closed.

To the contrary, if the door 7 is closed in a dropping manner toward the direction C in FIG. 1, the force f acting on the safety mechanism in spontaneously increased greatly as a shock force. In this case, among the force components generating the moments $T_{30}$, $T_{40}$, force components ($f_1 \times L$) and ($f_1' \times L'$) are increased in proportional to the value of the force f. In particular, since the force $f_1$ is greater than the force component $f_1'$ ($f_1 > f_1'$), an increase amount of the moment $T_{30}$ becomes greater. However, spring forces of the springs 31, 41 for biasing the levers 30, 40 are unchanged. Further, a friction force acting on the lever 30 from the lever 40 and a friction force acting on the lever 40 from other parts are unchanged. Incidentally, although friction forces acting on the levers 30, 40 from the support shafts 32, 42 and associated bearings are changed, elastic deformation and bounding are generated in each contact portion. So, magnitude of the friction forces acting between the support shafts 32, 42 and the bearings is unstable for a short time period.

Accordingly, when the force component $f_1$ is increased, the relation of ($15 \times T_{30} \leqq T_{40}$) is disappeared and a relation of ($15 \times T_{30} > T_{40}$) is established. Consequently, the lever 30 is operated quickly under the increased force component $f_1$ of the force f, with the result that the levers 30, 40 are rotated to establish a relative positional relation (similar to FIG. 4) in which the levers are prevented from entering into the slit 11*a*.

Accordingly, the lever 30 acts as a stopper for the door trying to close. Thereafter, the door is bounded repeatedly with respect to the lever 30, and the bounding is gradually decreased. In this case, the levers 30, 40 and the body cover 11 constitute a "triangle" in which contact portions between the levers and the body cover are subjected to forces. When the bounding is gradually decreased, the force acting on the lever 30 from the door 7 is gradually decreased, and, ultimately, the lever 30 is shifted to a position where the lever can pass through the slit 11*a*. As a result, the door 7 is closed in a dropping fashion from the rock position (condition shown in FIG. 1), but, since this position is adequately low, shock generated is small.

In the safety mechanism according to the illustrated embodiment, the relative positional relation between the levers 30 and 40 constitute or do not constitute the triangle of the stopper in dependence upon whether or not the shock force acts. That is to say, when the lever 30 functions as an operation lever acting against only the shock force, the safety mechanism is operated, and, in the normal operation, the opening/closing operation is not obstructed.

As mentioned above, by providing the safety mechanism having two levers 30, 40 and two springs 31, 41, the function for preventing the damage of the printer itself (due to the dropping of the door) by operating the stopper on the way can be achieved cheaply with small space.

<Second Embodiment>

Next, a second embodiment of the present invention will be explained with reference to FIGS. 5 and 6.

A safety mechanism according to a second embodiment has the same stopper function (for preventing the dropping of the door of the laser beam printer) as the first embodiment and is constituted by a single rotatable lever 40 and a slidable lever 30 supported for sliding movement in a straight direction.

Figure 5:
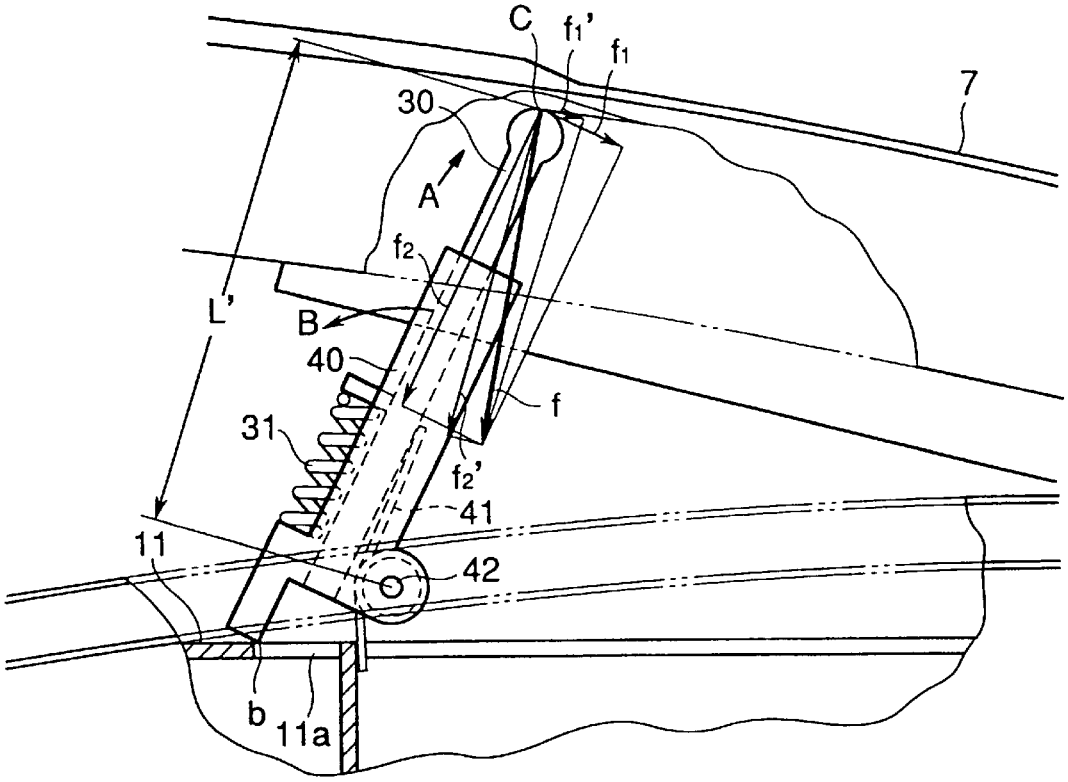
FIG. 5 is an enlarged detailed view of a safety mechanism of a laser beam printer having the safety mechanism according to a second embodiment of the present invention.

As shown in FIG. 5, the lever 40 is rotatably mounted on a body cover 11 via a support shaft 42 and is biased toward a direction shown by the arrow B in FIG. 5 by a spring 41, so that posture of the lever shown in FIG. 5 is maintained by abutting the lever against the body cover 11 at a point b. The lever 30 is slidably fitted in a rail portion (not shown) of the lever 40 for shifting movement along the lever 40 and is biased toward a direction shown by the arrow A in FIG. 5 by a spring 31, so that posture of the lever 30 shown in FIG. 5 is maintained by abutting the lever 30 against a stopper (not shown) on the rail portion.

When the door 7 is being closed, the door 7 is contacted with the lever 30 at a point c, so that the lever 30 is subjected to a force f from the door 7. The force f has a force component $f_2$ directing toward a movable direction of the lever 30 and a force component $f_1$ directing toward a direction perpendicular to the movable direction. Further, the force f has a force component $f_1'$ directing toward a movable direction of the lever 40 around the support shaft 42 and a force component $f_2'$ directing toward a direction of the support shaft 42.

When it is assumed that a distance between the contact point c and the support shaft 42 is L', moment $T_{40}$ for rotating the lever 40 around the support shaft 42 is represented by the following equation:

$$T_{40} = f_1' \times L' - (\text{moment of spring 41}) - (\text{moment due to friction force})$$

Further, a force $F_3$ for moving the lever 30 in a direction opposite to the direction A is represented by the following equation:

$$F_3 = f_2 - (\text{biasing force of spring 31}) - (\text{friction force})$$

When the door 7 is closed slowly, the biasing forces of the springs 31, 41 are selected so that the lever 30 is shifted by a distance of 10 mm or less along the direction of the rail while the lever 40 is being rotated by 8 degrees in consideration of static coefficient of friction. Thus, when the door 7 is closed slowly, a lower end of the lever 30 is nor entered into a slit 11*a* of the body cover 11. As a result that, the lever 40 can be rotated greatly, so the levers 30, 40 are laid up to positions shown by the two dot and chain lines in FIG. 6. Thus, the door 7 can be closed.

To the contrary, if the door 7 is dropped to collide against the lever 30, the shock force acts on the lever 30 to thereby increase the force f greatly. In this case, although the force components $f_1'$, $f_2$ are also increased, the biasing forces of the springs 31, 41 and the friction forces are unchanged. Although the force component $f_2$ is generally great, the force $F_3$ has become small since the force component $f_2$ is canceled out with the biasing force of the spring 41 and the friction force. When the force components $f_1'$, $f_2$ of the force f are increased by several times due to the shock force, the force component $f_2$ is generally great, so an increase amount of the force $F_3$ becomes considerably greater than an increase amount of the moment $T_{40}$.

Figure 6:
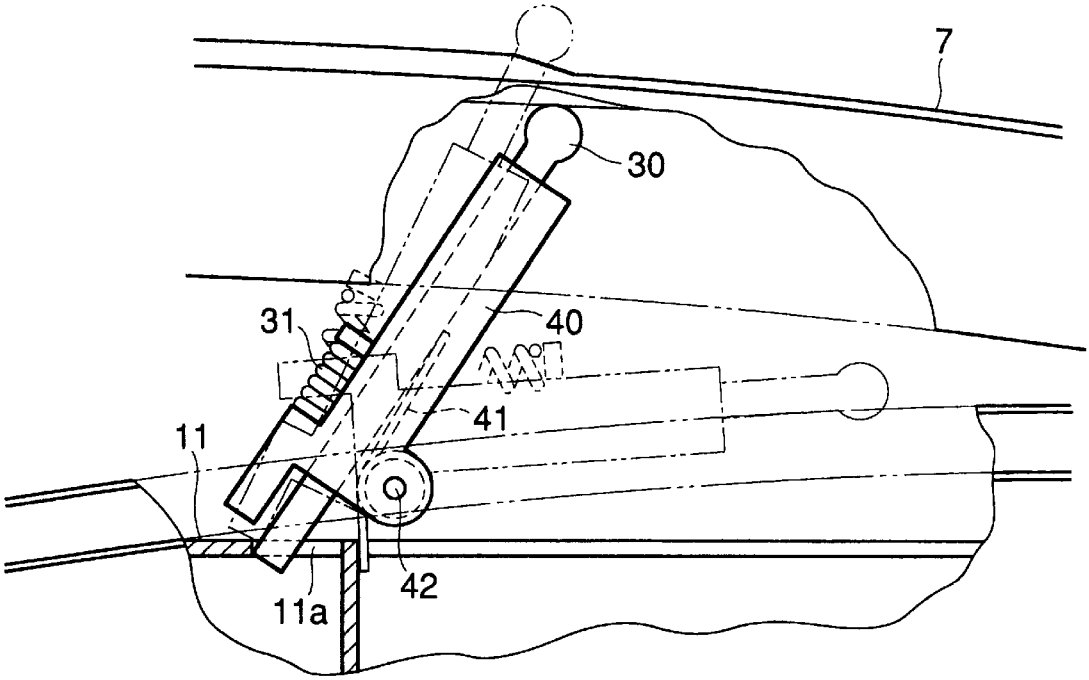
FIG. 6 is an explanatory view for explaining an operation of the safety mechanism according to the second embodiment.

Accordingly, the lever 30 is protruded from the lever 40 downwardly by a distance of 11 mm or more, so that the lever 30 is caught by the end of the slit 11*a* of the body cover 11, as shown by the solid line in FIG. 6. Consequently, the lever 40 cannot be laid from the solid line position. As a result, the door 7 cannot be closed and, thus, is stopped on the way and is bounded at a contact point between the door and the lever 30. When the bounding of the lever 30 is gradually decreased to decrease the force f acting on the lever 30 sufficiently, the door 7 is closed while laying the lever 40.

As mentioned above, also in the second embodiment, even if the door 7 is dropped, the function for preventing the damage of the printer itself by operating the stopper on the way can be achieved cheaply with small space.

<Third Embodiment>

Next, a third embodiment of the present invention will be explained with reference to FIGS. 7 to 9.

A safety mechanism according to a third embodiment differs from the safety mechanisms of the first and second embodiments in the following three points:

(i) A weight 50 is used as a biasing means for a slider lever 40 which can cope with a slow movement but is delayed for the fast load. Unlike to the biasing of the spring, the biasing of the weight 50 causes the delay in response of the lever 40 in comparison with the lever 30 due to inertia of the weight 50.

(ii) The lever which is moved in the delayed fashion is a straight movement slider lever 40, and the lever which is quickly moved is a rotatable lever 30.

(iii) The safety mechanism constitutes an independent device.

Figure 7:
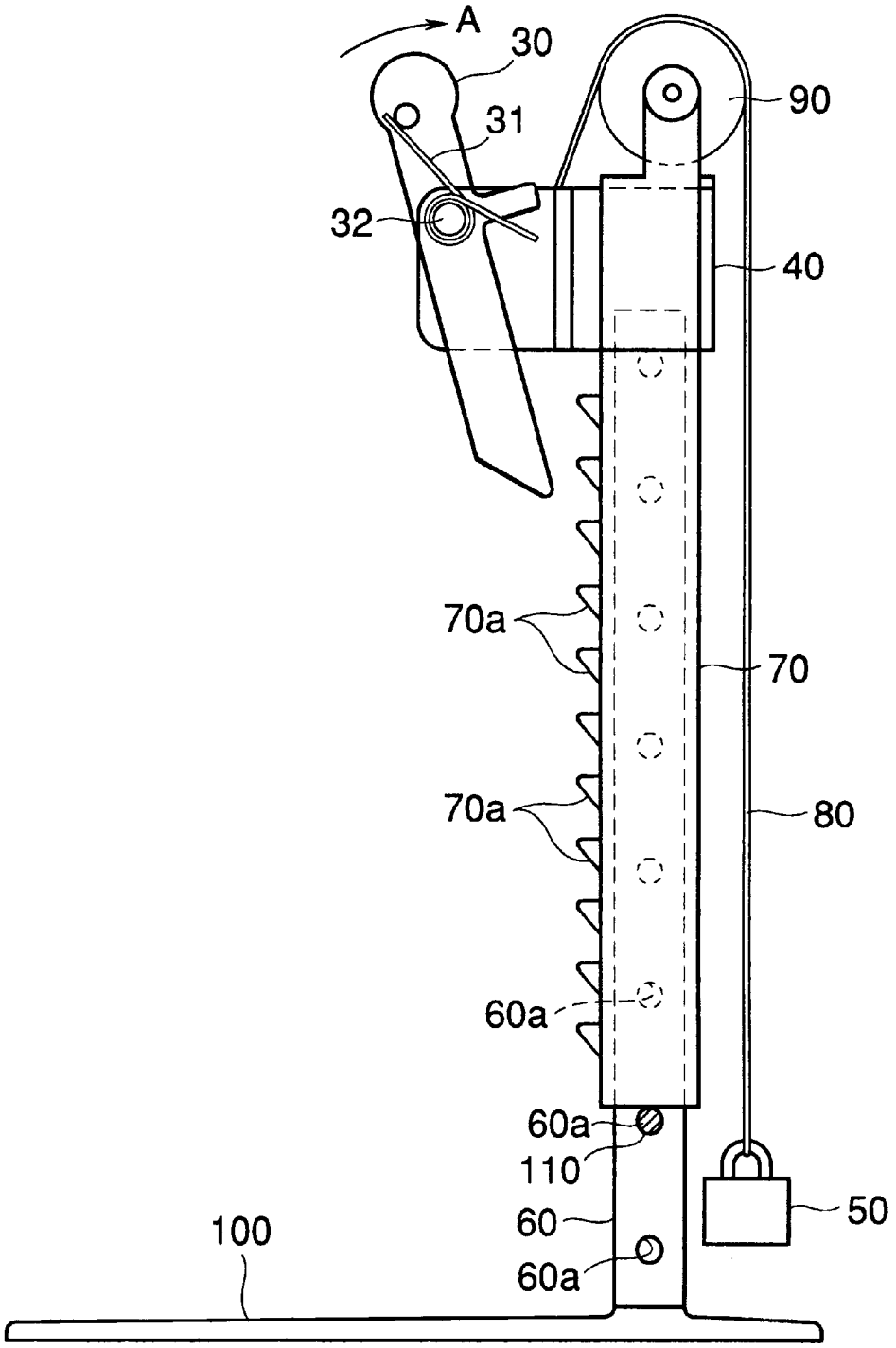
FIG. 7 is a side view of a safety mechanism according to a third embodiment of the present invention.
Figure 8:
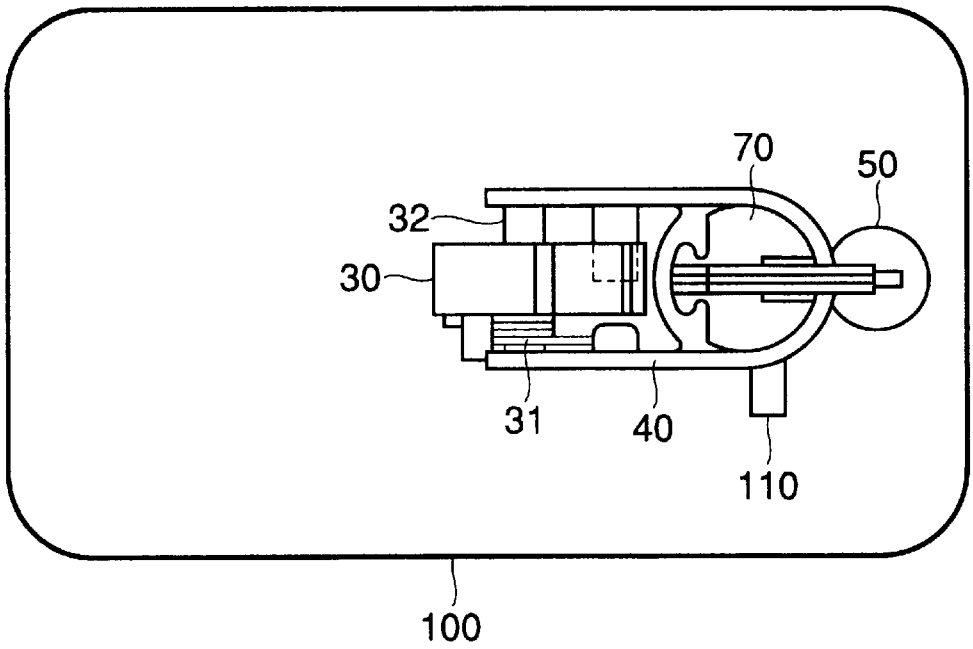
FIG. 8 is a plan view of the safety mechanism according to the third embodiment.

As shown in FIGS. 7 and 8, the safety mechanism according to the third embodiment includes a first post 60 uprightly formed on a base portion 100, and a second post 70 fitted on the first post 60. A plurality of holes 60*a* is formed on the first post 60 so that a height of the safety mechanism can be changed by inserting a pin 110 into one of the holes 60*a*.

The slider lever 40 is fitted onto the second post 70, and the slider lever 40 is connected to one end of a wire 80 wound around a pulley 90 rotatably mounted on an upper end of the second post 70. The weight 50 is connected to the other end of the wire 80 so that the slider lever 40 is biased upwardly to an uppermost position (FIG. 7) by the weight 50. The lever 30 is pivotally connected to the slider lever 40 via a support shaft 32, and the lever 30 is biased toward a direction shown by the arrow A in FIG. 7 by a spring 31.

Figure 9:
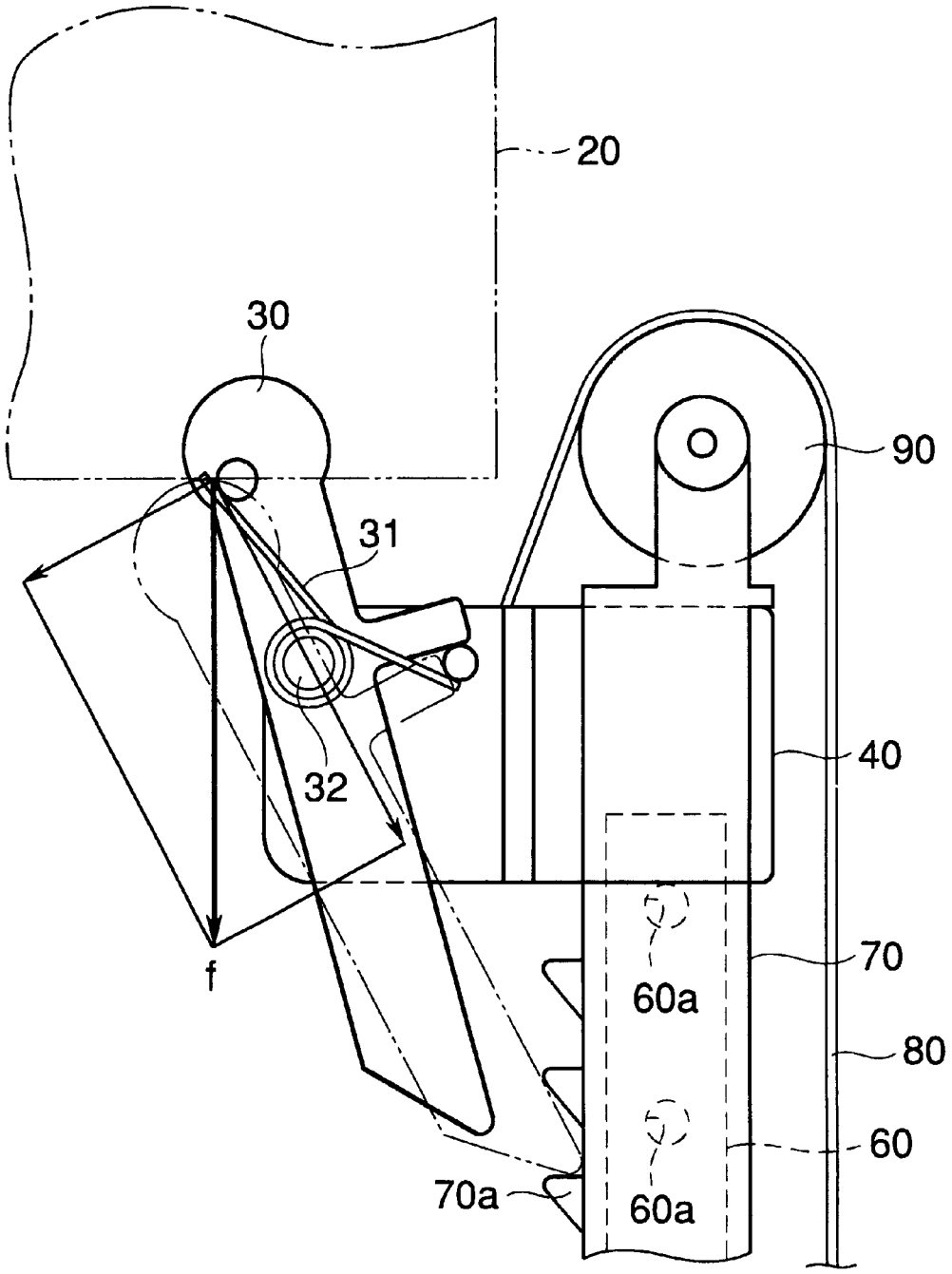
FIG. 9 is an explanatory view for explaining an operation of the safety mechanism according to the third embodiment.
Figure 10:
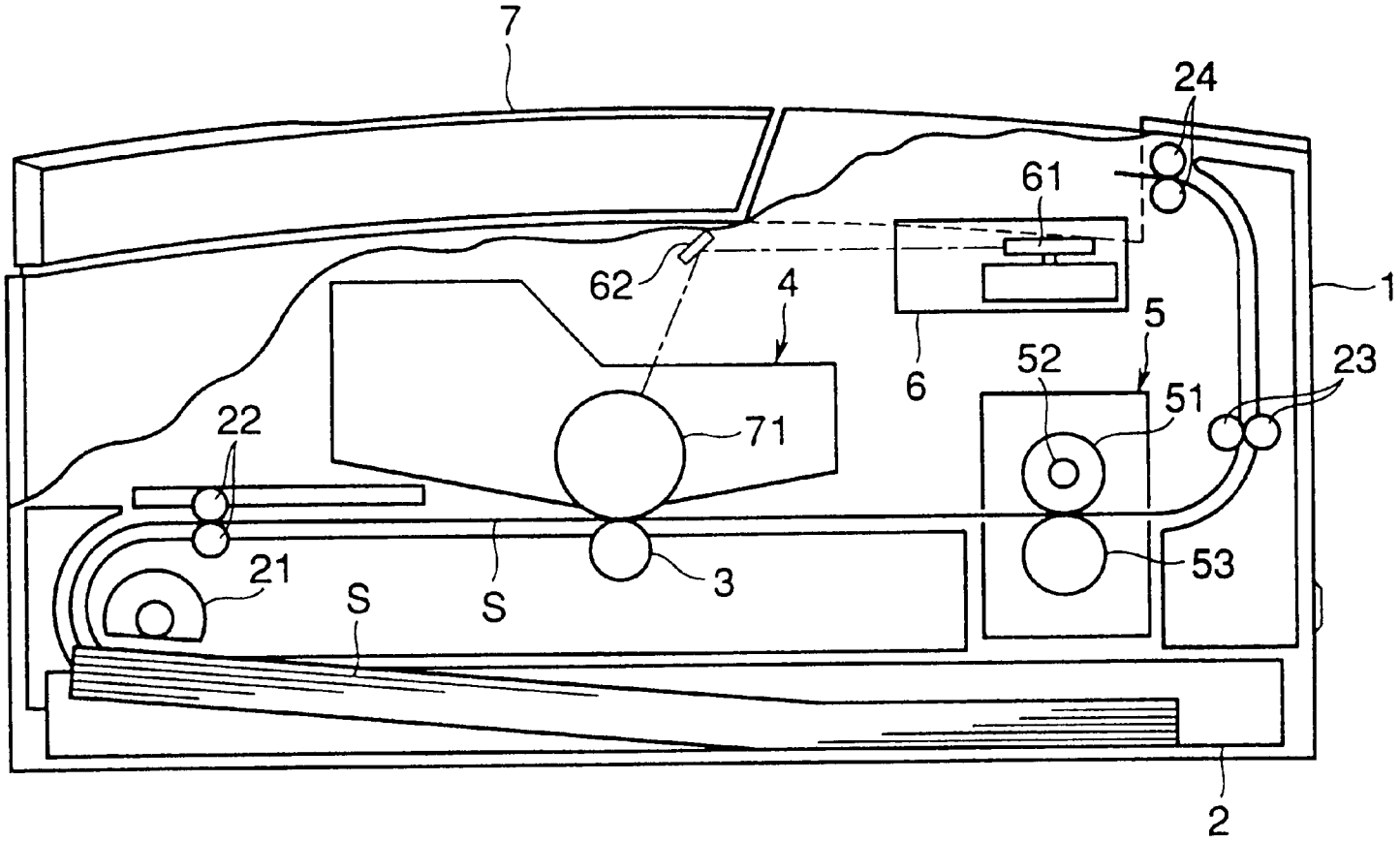
FIG. 10 is an elevational sectional view of a laser beam printer.
Figure 11:
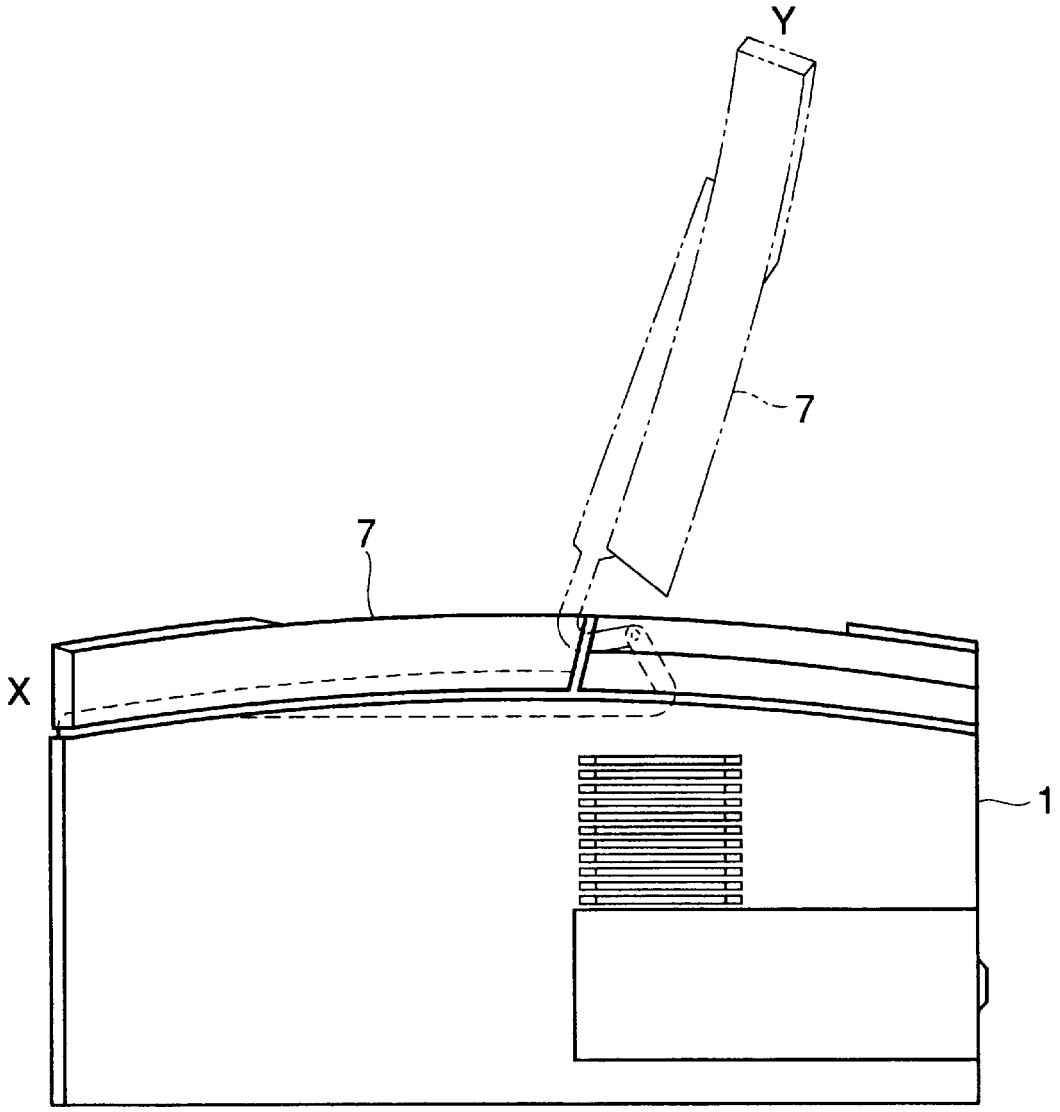
FIG. 11 is a side view of the laser beam printer, showing a condition that a door is opened.

FIG. 9 shows a condition that a lowered shutter 20 abuts against the lever 30. Since the shutter 20 is not moved laterally because it is guided by a rail (not shown), the shutter can be supported only by a stopper in a vertical direction. For example, the shutter 20 is a manually movable shutter for buildings which can be shifted in a vertical direction. When the shutter 20 is moved slowly, even if the shutter abuts against the lever 30, the lever 30 is rotated only by a small angle by the force of the spring 31 or is not rotated but is shifted together with the slider lever 40.

On the other hand, if the shutter 20 dropped for any reason, the shutter 20 is gradually accelerated as it is dropped. In this case, since the weight of the shutter is great, any object against which the shutter collides is greatly damaged. By temporarily stopping the dripped shutter at a certain height position to absorb the shock, the damage due to the dropping can be reduced.

When the shutter is naturally dropped, the force f acting on the lever 30 becomes greater than the force acting on the lever 30 when the shutter 20 is lowered slowly. Although such a great force f acts on the lever 30, since the force of the spring 31 and the friction force are unchanged, the lever 30 is rotated around the support shaft 32.

On the other hand, the slider lever 40 is subjected to a force for lowering the slider lever. However, the slider lever 40 is biased upwardly by the weight of the weight 50 via the wire 80. Accordingly, when the great force acts on the lever 30, the inertia of the slider lever 40 and the weight 50 acts as a force preventing the change in speed of the slider lever 40. As a result, the lever 30 is moved quickly, so the lever 30 is engaged by one of pawls 70*a* formed on the second post 70 to thereby prevent the quick lowering of the slider lever 40. With this arrangement, if the force f is decreased, the lever 30 is returned to its initial position, so that the shutter 20 is lowered together with the lever 30 and the slider lever 40.

As mentioned above, according to the safety mechanism having two levers 30, 40, a single spring 31 and a single weight 50, a stopper function for suppressing the dropping of the shutter 20 can be achieved cheaply with small space.

As mentioned above, according to the present invention, the safety mechanism acts as the stop device when the load acting on the open/close member becomes greater than the predetermined set value and does not act as the stop device when the load acting on the open/close member is smaller than the predetermined set value. So the safety mechanism is not operated during the normal operation to permit the closing of the open/close member, and is operated only when the strong strong force is applied to thereby preventing the dropping of the open/close member.

What is claimed is:

1. A safety mechanism for an open/close door member of an image forming apparatus, comprising:

a door member rotated around one axis to be opened and closed in a gravity force direction;

a first lever member abutting against said door member in a closed condition;

a second lever member rotatably attached to a body of the apparatus to support said first lever member; and means for biasing said first and second lever members;

wherein when a load acting on said first lever member from said door member is greater than a set value, said first lever member is shifted to a predetermined position to function as a stop device for stopping rotation of said door member; and, when the load is smaller than the set value, the rotation of said door member is permitted.

2. A safety mechanism according to claim 1, wherein said first lever member is biased toward said second lever member.

3. A safety mechanism according to claim 1, wherein the set value is determined on the basis of rotational moment generated by pushing said first lever member by said door member.

4. A safety mechanism according to claim 1, wherein said image forming apparatus is an electrophotographic apparatus, and wherein said door member is opened when maintenance of said apparatus is performed and closed after said maintenance is performed.

* * * * *

UNITED STATES PATENT AND TRADEMARK OFFICE

CERTIFICATE OF CORRECTION

PATENT NO. : 5,995,784
DATED : November 30, 1990
INVENTOR(S) : Chitose Tempaku

It is certified that error appears in the above-identified patent and that said Letters Patent is hereby corrected as shown below:

Column 2,
Line 33, "with the so" should read -- so --.

Column 5,
Line 2, "proportional" should read -- proportion --; and
Line 13, "is" should read -- are --.

Column 6,
Line 29, "nor" should read -- not --; and
Line 30, "that" should be deleted.

Column 8,
Line 21, "strong" (second occurrence) should be deleted.

Signed and Sealed this

Nineteenth Day of March, 2002

*Attest:*

*Attesting Officer*

JAMES E. ROGAN
*Director of the United States Patent and Trademark Office*